United States Patent [19]

Horiike et al.

[11] Patent Number: 4,970,488

[45] Date of Patent: Nov. 13, 1990

[54] NOISE-SUPPRESSING HIGH VOLTAGE CABLE AND METHOD OF MANUFACTURING THEREOF

[75] Inventors: Tsuneyuki Horiike; Toshio Inada; Masahiro Kanda, all of Shizuoka, Japan

[73] Assignee: Yazaki Corporation, Japan

[21] Appl. No.: 311,777

[22] Filed: Feb. 17, 1989

[30] Foreign Application Priority Data

Feb. 19, 1988 [JP] Japan ..... 63-35306

[51] Int. Cl.[5] ..... H01C 3/06; H01C 7/00

[52] U.S. Cl. ..... 338/214; 338/66; 174/102 SC; 174/120 SC

[58] Field of Search ..... 338/214, 66; 174/120 SC, 102 SC

[56] References Cited

U.S. PATENT DOCUMENTS

| | | | |
|---|---|---|---|
| 3,284,751 | 11/1966 | Barker et al. | 338/66 |
| 3,518,606 | 6/1970 | Barker | 338/214 |
| 3,683,309 | 8/1972 | Hirose | 338/214 |
| 3,870,987 | 3/1975 | Wiley et al. | 338/214 |
| 4,431,982 | 2/1984 | Monroe et al. | 338/214 |
| 4,435,692 | 3/1984 | Miyamoto et al. | 338/66 X |
| 4,689,601 | 8/1987 | Coffey et al. | 338/214 |
| 4,748,436 | 5/1988 | Kanamori et al. | 338/214 |
| 4,818,438 | 4/1989 | Wiley | 338/214 X |

*Primary Examiner*—Bruce A. Reynolds
*Assistant Examiner*—M. M. Lateef
*Attorney, Agent, or Firm*—Wigman & Cohen

[57] ABSTRACT

A high voltage cable having a wound conductor made by winding a metallic wire around a ferrite rubber covered reinforcing core, in which the ferrite rubber layer is additionally provided with conductive particles or fibers in order to improve noise suppression characteristics in the 30–200 MHz frequency range.

18 Claims, 12 Drawing Sheets

NOISE-SUPPRESSING HIGH VOLTAGE CABLE AND METHOD OF MANUFACTURING THEREOF

BACKGROUND OF THE INVENTION

1. Field of the Invention

The present invention relates to a wound, high voltage radio noise resistant cable, and more particularly to a wound, high voltage radio noise resistant cable having excellent durability and noise prevention characteristics in the 30–200 MHz frequency range, and which is adapted principally for use in the ignition circuits of gasoline engines for automobiles.

2. Description of the Prior Art

It is commonly known that the ignition circuits of gasoline engines for automobiles tend to generate radio noise which can disrupt television and radio signals and sometimes even cause malfunctions to occur within other electical circuits or elements of the automobile. In order to alleviate this problem, the ignition circuit is generally provided with an ignition cable having properties that allow it to prevent such radio noise from occurring.

In the prior art of ignition cables used for the above-mentioned purpose, two types are generally employed. The first type of cable is constructed so as to have a centralized resistor which acts as a bulk resistor, and the second type of cable is constructed so as to have a resistor formed from a non-conductive fibrous material impregnated with a carbon-based powder.

However, for the first type of cable mentioned above, the centralized resistor generates a series resonance from 100 MHz to 200 MHz due to the equivalent capacitance of the centralized resistor and the inductance of the high voltage wire, and this results in markedly reduced radio noise suppression. Similarly, the second type of cable mentioned is insufficient at suppressing radio noise because there is a diminution in impedance due to the equivalent capacitance of the resistor.

Due to the drawbacks of the two types of cables described above, a cable having superior radio noise prevention was proposed as shown in FIG. 1. Namely, the cable 1 comprises a core 2 made from glass fiber or the like which is covered with ferrite rubber 3. Wound around the ferrite rubber covering 3 in the axial direction of the cable is a metallic resistance wire 4, which is in turn covered with an insulator 7. Provided over the insulator 7 is a braided reinforcing which is further covered with a sheath 9.

In the structure of the cable shown in FIG. 1 as described above, the ferrite rubber covering 3 is formed by the addition of ferrite powder to a base polymer. Therefore, the radio noise suppression capacity of the cable depends on such factors as the permeability of the ferrite powder, the thickness of the ferrite rubber covering 3, and the amount of the ferrite added to the base polymer. Consequently, in order to obtain a sufficient radio noise suppression effect, a thick layer of ferrite rubber containing a large amount of high permeable ferrite powder must be provided over the core 2 of the cable. As a result, production costs become quite high and there is a loss of general utility. In addition, since the rubber covering 3 has to be made relatively thick, the overall weight of the cable is increased while the operability is reduced due to a large voltage drop arising from an increase in the electrostatic capacitance of the wire.

In response to the shortcomings of the cable shown in FIG. 1, U.S. Pat. No. 4,435,692 disclosed a wound, high voltage cable having a low electrostatic capacitance. As described in this disclosure, the cable is constructed with a polyaramide fiber reinforcing core having a diameter of less than 1.3 mm which, by virtue its small diameter, allows ferrite rubber covering to be formed to a desired thickness without drastically enlarging the entire diameter of the cable.

Unfortunately, however, even though the diameter of the reinforcing core of the cable disclosed in U.S. Pat. No. 4,435,692 is reduced in comparison to the reinforcing core of the cable shown in FIG. 1, the thickness and composition of the ferrite rubber covering for both these cables remains essentially the same. Therefore, even though there is a difference in the overall diameters for these two cables, the cable disclosed in U.S. Pat. No. 4,435,692 does not provide sufficient improvement of radio noise suppression characteristics.

Accordingly, it has been an ongoing task in this field to try to make a high voltage cable capable of satisfactorily suppressing radio noise, particularly radio noise in the range of 30–200 MHz, even when the thickness of the ferrite rubber covering the reinforcing core is reduced.

SUMMARY OF THE INVENTION

In view of all the disadvantages of the prior art high voltage cables mentioned previously, and with a view toward ending the long search for a way to overcome such disadvantages, it is an object of the present invention to provide a high voltage cable which can satisfactorily suppress radio noise in the range of 30–200 MHz.

It is another object of the present invention to provide a high voltage cable which can satisfactorily suppress radio noise in the range of 30–200 MHz even when the cable is formed with a relatively thin ferrite rubber layer.

For achieving the above-mentioned objects, a high voltage cable according to the present invention comprises a reinforcing core formed from an organic or inorganic fiber covered by a rubber material containing both ferrite powder and electrically conductive particles in specific weight proportion ranges, over which is wound, in the axial direction thereof, a metallic resistance wire at a rate of 30–150 turns/cm, which is then covered by an insulating layer and a cover sheath.

In the basic construction described above, it is the provision of the specially formed rubber layer that enables a cable to be made in concert with the previously mentioned objectives. Namely, by forming a rubber layer containing both ferrite powder and electrically conductive particles, the cable is capable of satisfactorily suppressing radio noise in the range of 30–200 MHz even when only a relatively thin rubber layer is provided.

The foregoing, and other objects, features, and advantages of the present invention will become more apparent from the detailed description of the preferred embodiments taken in conjunction with the accompanying drawings.

DETAILED DESCRIPTION OF THE PREFERRED EMBODIMENTS

Figure 1:
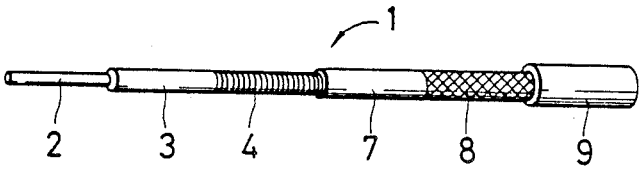
FIG. 1 PRIOR ART
FIG. 1 is a perspective view of a prior art high voltage cable.
Figure 2:
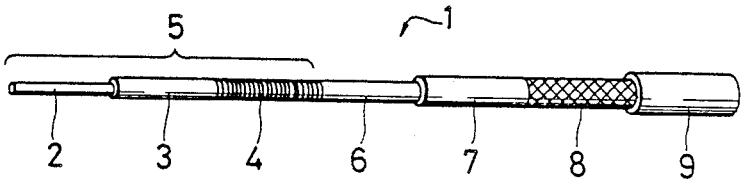
FIG. 2 is a perspective view of a high voltage cable in accordance with the present invention.

With reference to FIG. 2, an embodiment of the present invention is shown. Namely, a high voltage cable 1 is shown having a reinforcing core 2 which is covered by a ferrite rubber layer 3. Over the ferrite rubber layer 3 is wound a metallic resistance wire 4 which, together with the reinforcing core 2 and the ferrite rubber layer 3, comprise a wound conductor 5. Provided around the outer periphery of the wound conductor 5 is an insulating layer 7, which is in turn covered by a cover sheath 9. Further, the high voltage cable can be additionally provided with a strip layer 6 between the conductor 5 and the insulating layer 7 to facilitate stripping of the insulating layer 7, and a reinforcing layer 8 between the insulating layer 7 and the cover sheath 9.

With the basic overall structure of the high voltage cable being defined above, detailed descriptions of each element thereof will now be given.

First, for the reinforcing core 2 of the cable 1, use can be made of either inorganic fibers such as glass fibers, or organic fibers such as aromatic polyamide fibers and aromatic fibers which can be used individually or together. However, the preferred practice would be to form the reinforcing core 2 using aromatic polyamide fibers and/or aromatic polyester fibers due to their excellent thermal resistance and tensile strength.

Next, for the ferrite rubber layer 3 that covers the reinforcing core 2, a base polymer is employed which contains ferrite powder and electically conductive particles. The base polymer can be chosen from any of the following: cross-linkable rubbers such as diene rubber of ethylene-α-olefin-diene copolymer, fluororubber butyl rubber, silicone rubber or the like; ethylene-series synthetic resins such as chlorinated polyethylene, chlorosulfonated polyethylene or the like; α-olefin copolymer synthetic resins such as ethylene-propylene copolymers or the like; or α-olefin-vinyl monomer copolymers such as ethylene-vinyl acetates and ethylene-ethylacrylate copolymers. Among all these base polymers ethylene-propylene-diene ternary copolymer, silicone rubber and fluororubber are preferred in view of their thermal resistances.

As for the ferrite powder contained in the base polymer of the ferrite rubber layer 3, use can be made of Mn-Zn based ferrite, Ni-Zn based ferrite, or Cn-Zn based ferrite. In addition, these various ferrite powders can be used alone or in combination, but the preferred choice would be to use the Mn-Zn based ferrite.

The amount of ferrite added to the base polymer is 300–800 parts by weight for every 100 parts by weight of the base polymer, with the preferred range being 400–700 parts by weight. The reason for choosing these ranges is that if the amount of ferrite powder contained in the base polymer is less than 300 parts by weight, radio noise suppression will be insufficient, and if the amount exceeds 800 parts by weight, the ferrite rubber layer 3 becomes incapable of being used as a covering for the reinforcing core 2 due to a marked reduction in its extrusion property.

As for the electrically conductive particles, carbon black, graphite powder, carbon fiber, graphite fiber, metallic powder or metallic fiber may be used separately or in mixtures of two or more. Of these, carbon black, carbon fiber, graphite powder and graphite fiber are the preferred choices in view of their mixing ease and subsequent extrudability of the mixture.

The amount of addition of the conductive particles is 5–70 parts by weight for every 100 parts by weight of the base polymer, with a preferred range of 10–50 parts by weight. The reasons for choosing this range is similar to the reasons given above for choosing a specific range of ferrite. Namely, if the quantity of added conductive particles is smaller than 5 parts by weight, there is virtually no improvement in the radio noise suppression characteristics of the cable, and if the quantity is more than 70 parts by weight, a reduction will occur in the extrudability of the ferrite rubber layer 3.

In order to form the ferrite rubber layer 3 around the reinforcing core 2, a ferrite rubber composition containing the ferrite powder and the electrically conductive particles is obtained by compounding an antioxidant, a cross-linking agent, and a processing aid, or the like, as needed. Then the ferrite rubber composition is coated around the reinforcing core 2 by extrusion or the like. In any case, the compounding agent may be increased or decreased within the range allowable for forming a covering around the reinforcing core 2.

Next, in order to form the wound conductor 5, the metallic resistance wire 4 is wound around the outer surface of the ferrite rubber layer 3 in the axial direction thereof. The rate of winding of the metallic wire 4 is preferrably in the range of 30–150 turns/cm, and any suitable wire, such as Ni-Cr wire or stainless steel wire, may be employed. Here, too, the range is very important because if the rate of winding is fewer than 30 turns/cm, sufficient radio noise suppression cannot be achieved, while if the rate is above 150 turns/cm, there occurs too much contact among the individual turns which makes it difficult to obtain a wound conductor 5 with a predetermined resistance.

Over the wound conductor 5 is the insulating layer 7, which may be formed from any of the following or their equivalents: an ethylene-α-olefin-diene ternary copolymer such as polyethylene or or ethylene-propylene-diene ternary copolymers; an ethylene-α-olefin copolymer such as ethylene-propylene copolymer; existing known blended compositions such as silicone rubber; or a blend of any of the insulating materials just mentioned.

The particular choice of insulating materials depends on the specific characteristics sought for the insulating layer 7. For instance, if electrical characteristics are the primary concern, then an insulating material having a dielectric constant in the range of 2.2–2.7, such as polyethylene and ethylene-α-olefin-diene ternary copolymers, would be the preferred choice. On the other hand, if thermal resistance is going to play a major role in choosing a proper insulating material, then the preferred choice would be silicone rubber or its equivalent.

In addition, it is also possible to obtain the required characteristics for the insulator by applying 2 or 3 extrusion coatings of a polyethylene blended composition or a blended composition of ethylene-propylene-diene ternary copolymers having low dieletric constants.

Now, as was described previously, a strip layer 6 can be provided between the wound conductor 5 and the insulating layer 7 for facilitating removal of the insulating layer 7, such as when the cable is to be spliced. In this case, the choice of the appropriate material for the strip layer can depend on several factors, but, in general, silicone oil, graphite powder or the like may be employed.

As for the other option of a reinforcing layer 8, braided glass fiber or aromatic polyamide fiber, perforated polyester tape, or the like may be employed around the outside periphery of the insulating layer 7, preferrably with a surface treatment using silane compounds in order to improve adhesion with the sheath 9. However, in view of cost and productivity, braided glass fiber would be the preferred choice.

Lastly, for the final covering that constitutes the sheath 9 of the high voltage cable 1, many existing rubber compositions may be used, such as chloroprene rubber compounded compositions, chlorosulfonated polyethylene compositions, chlorinated polyethylene compositions, ethylene-propylene-diene ternary copolymer compositions silicone rubber compositions, fluororubber compositions, or the like. Moreover, these compositions can be used alone or in blended combinations.

Now, for the purpose of demonstrating the radio noise suppression effect of the present invention, specific examples of the high voltage cable described above were made and tested in comparison with standards. The examples and standards can be classified into two groups: Group 1, which consists of examples A–J and a standard K; and Group 2, which consists of examples L and M and standards N and O.

Figure 3:
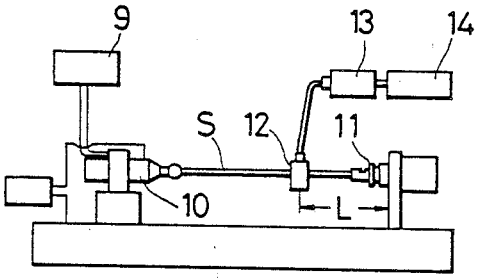
FIG. 3 is an explanatory diagram of an apparatus for measuring high-frequency noise.
Figure 4:
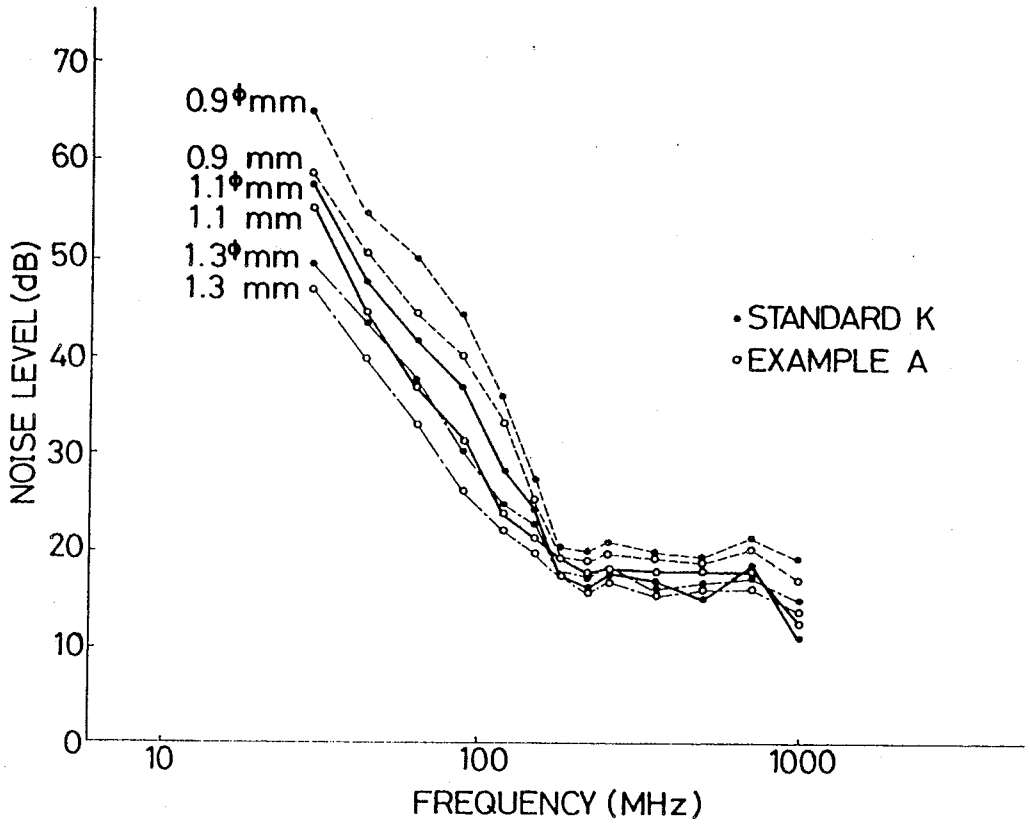
FIGS. 4–14 are graphs illustrating the noise suppression characteristics of examples of high voltage cables according to the present invention.
Figure 5:
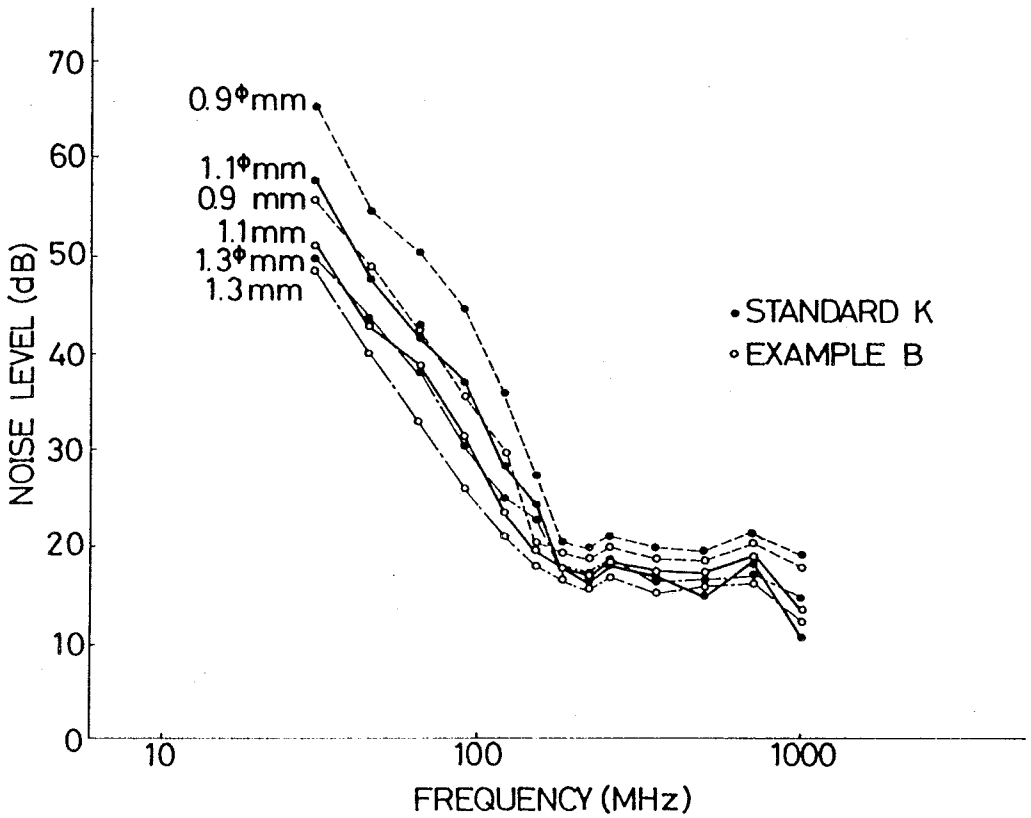
Figure 6:
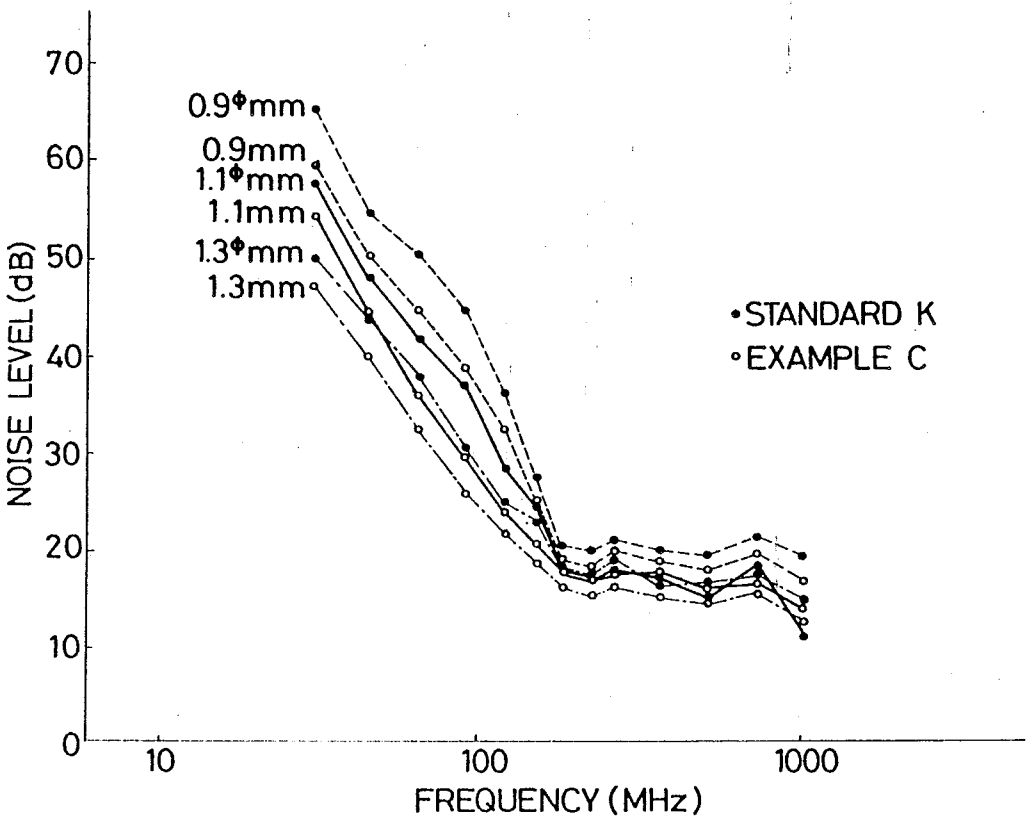
Figure 7:
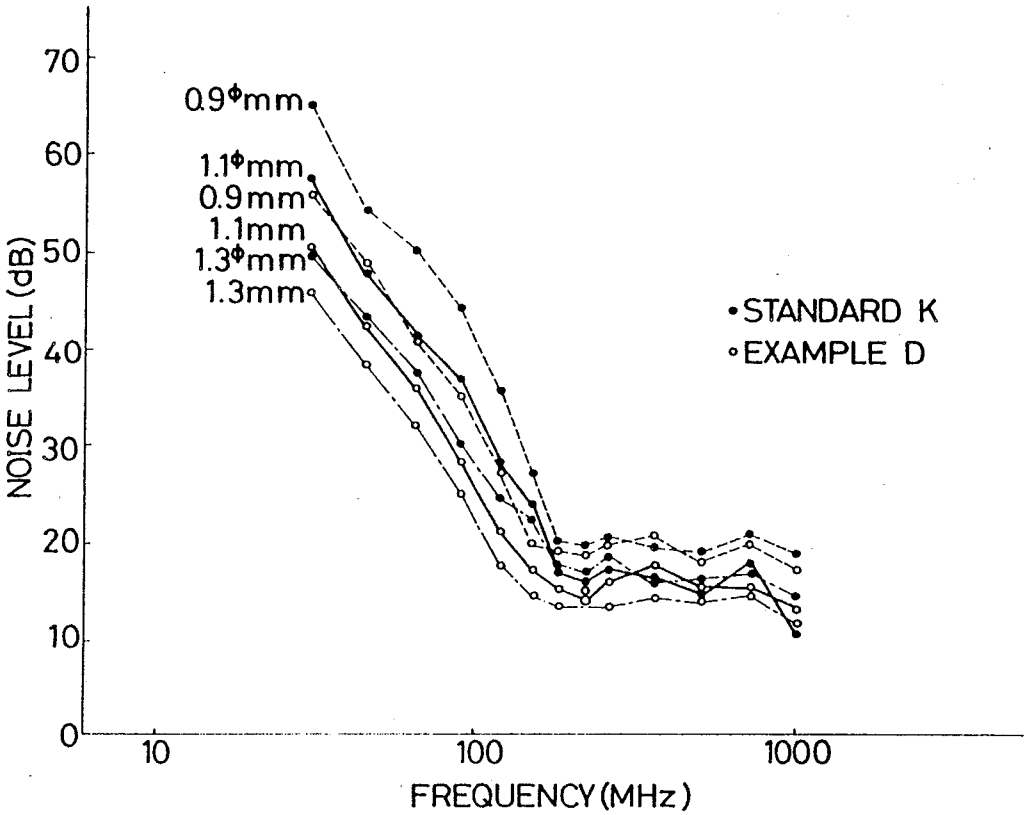
Figure 8:
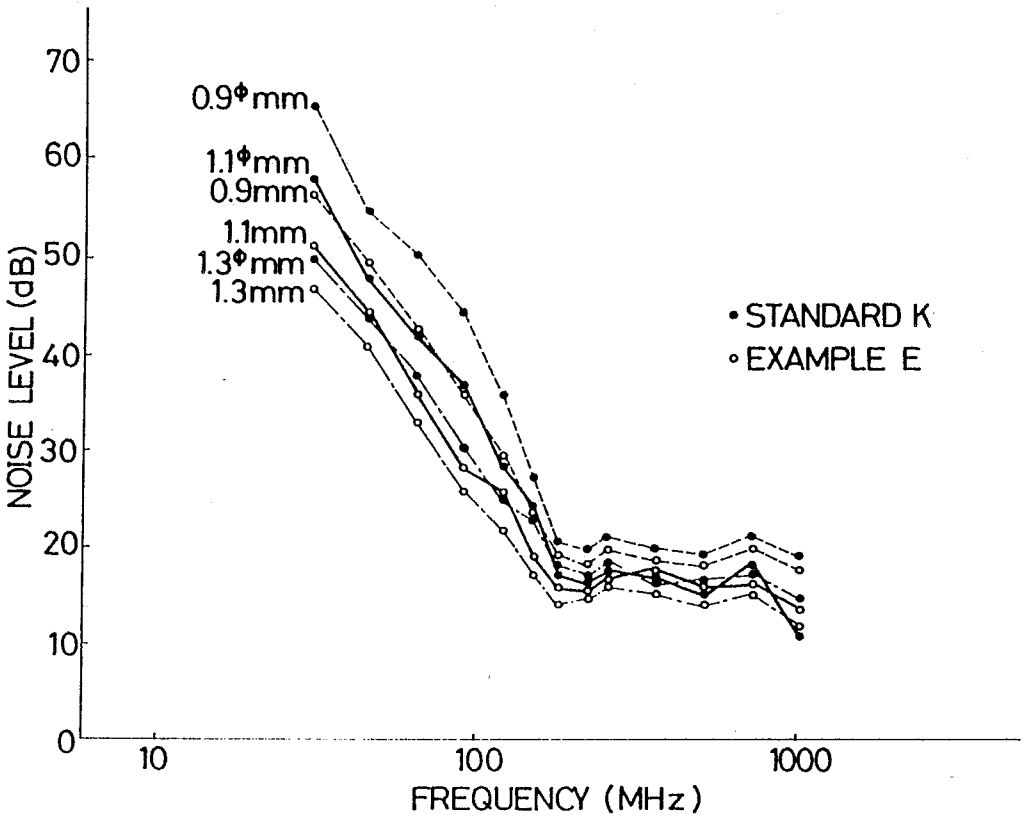
Figure 9:
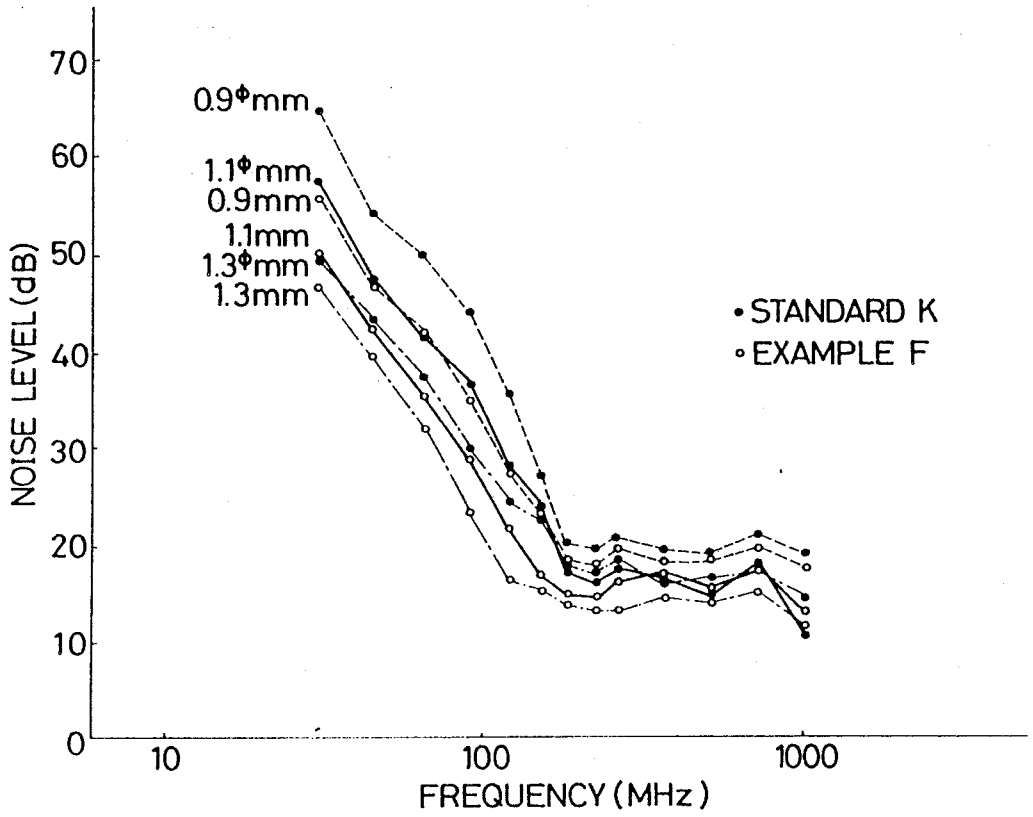
Figure 10:
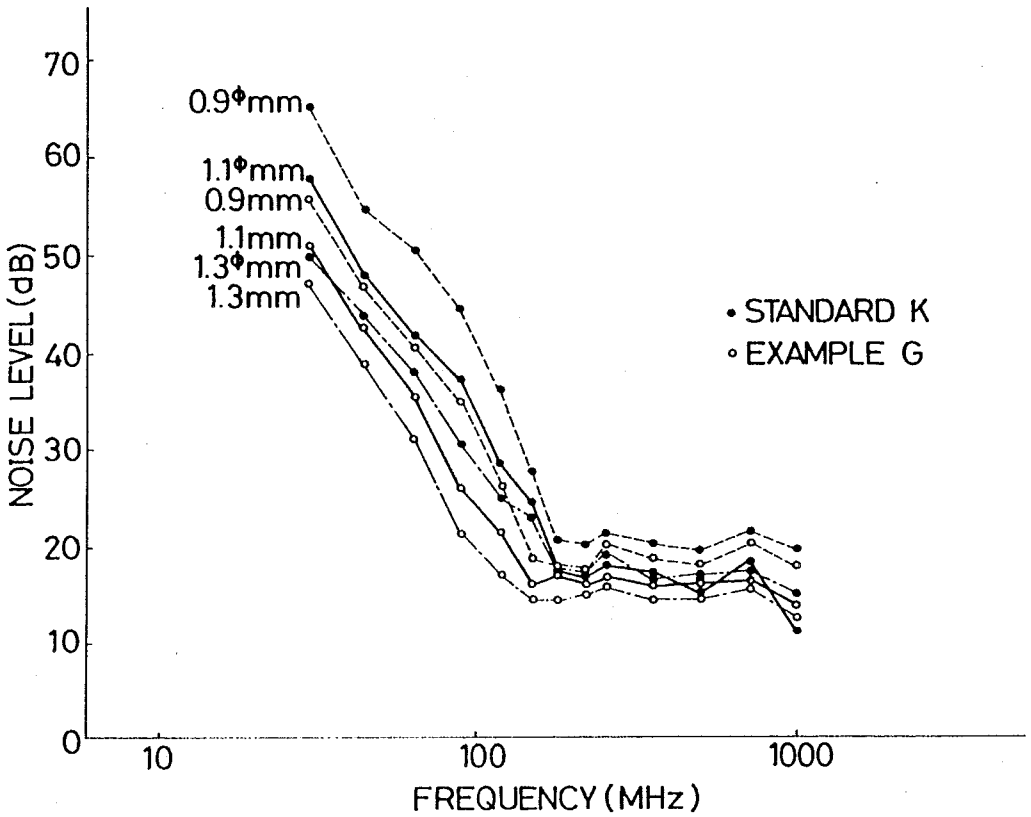
Figure 11:
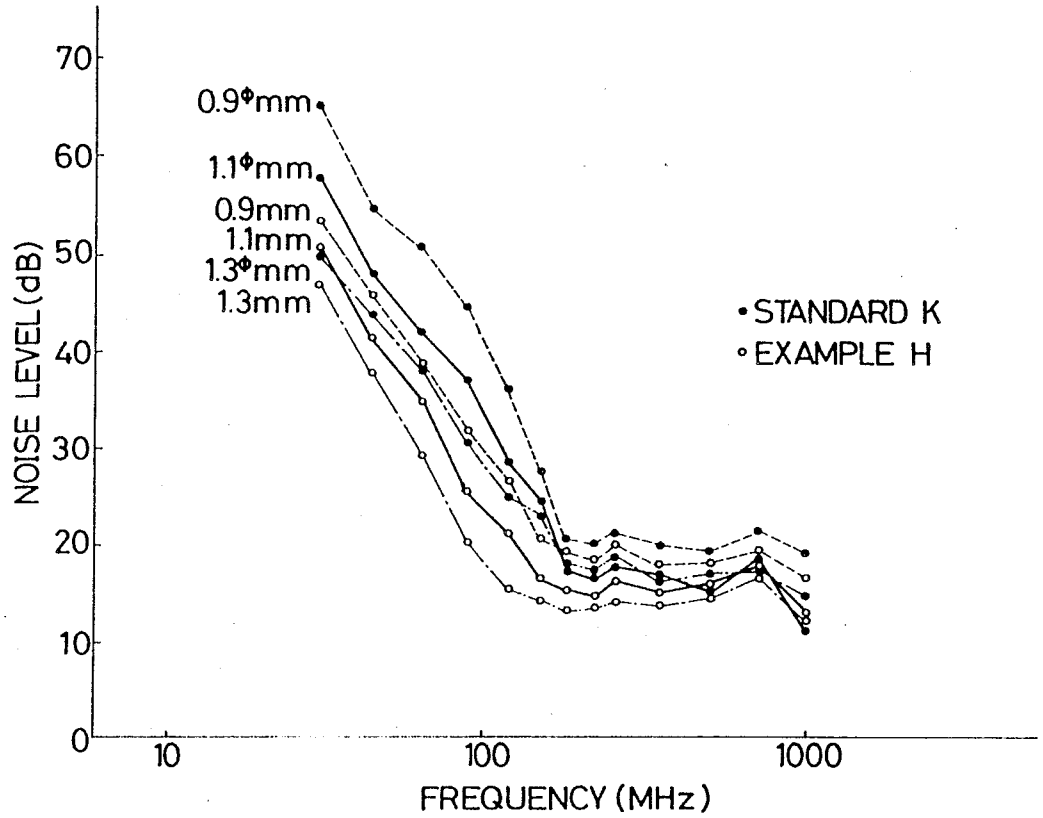
Figure 12:
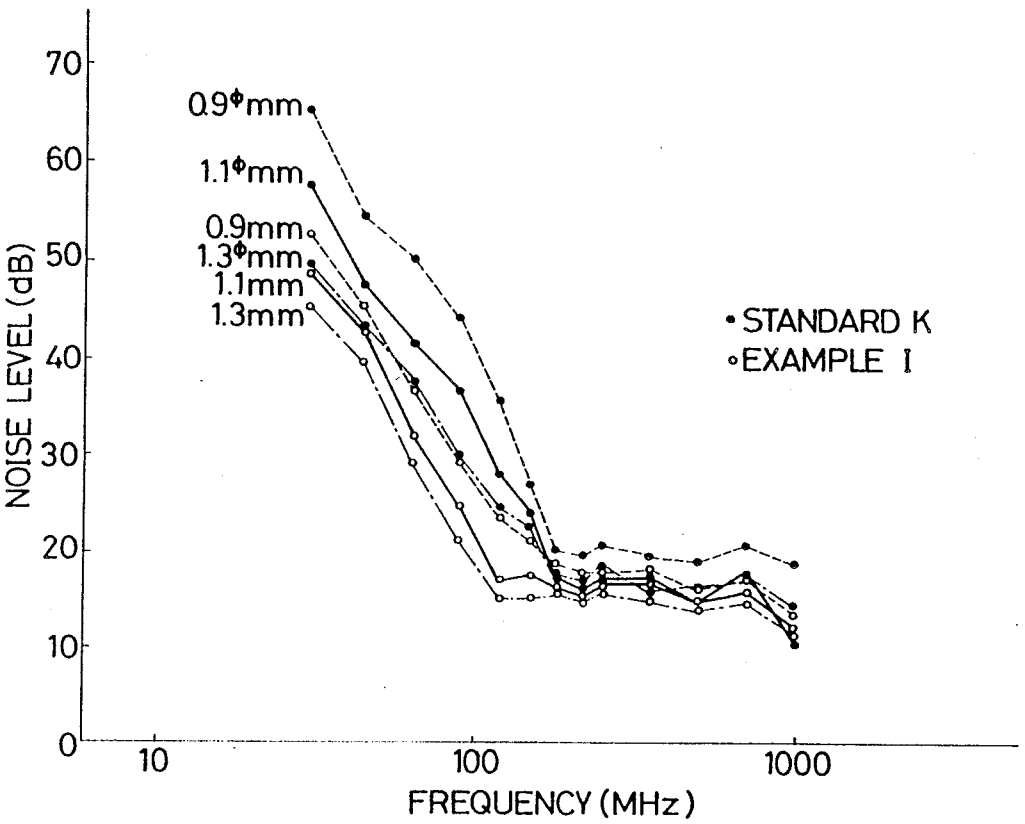
Figure 13:
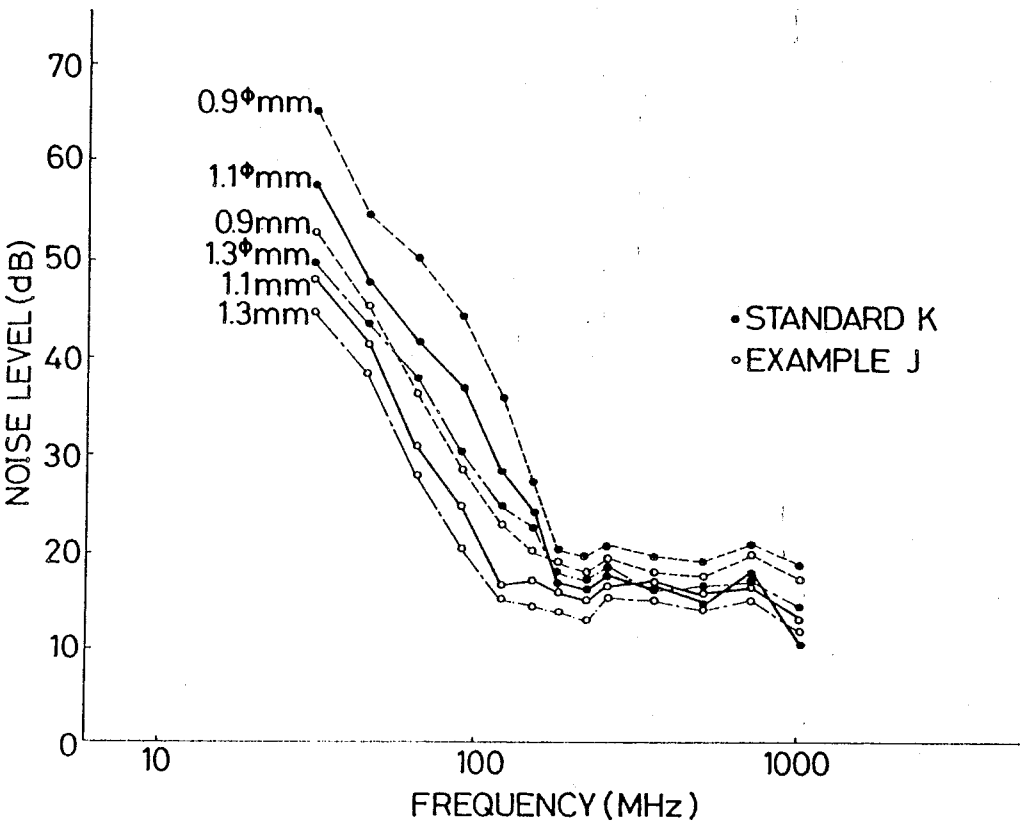

For both groups mentioned above, each example and standard was tested using the apparatus shown in FIG. 3. As illustrated, testing was carried out by connecting a sample cable S (approximately 50 cm long) between an ignition plug 11 and an igniter 10 controlled by a switching control unit 9, and measuring with a current probe 12 the electric field strength for various frequencies between 30 and 1000 MHz (namely, at 30, 45, 65, 90, 120, 150, 180, 220, 255, 360, 510, 720 and 1000 MHz) at various positions of the sample S located a distance L from the ignition plug 11 (namely, for L=0, 5, 10, 15, . . . , 45). The electric field strengths so detected by the current probe 12 are sent to a radio noise measuring device 13 and are then recorded by an X-Y recorder 14.

After all the data had been recorded, comparison graphs of the examples and standards were drawn up by plotting their corresponding electric field intensities (in decibels) A at each of the various frequencies mentioned above, in accordance with the formula: $A=A-20 \text{ Log } B$, where A is the electric field intensity for L=0, and B is the attenuation factor (dB/cm) of the electric field intensity for L=0 to L=30.

These comparison graphs will be best understood when viewed in conjunction with the following description of the respective groups:

GROUP 1 (EXAMPLES A–J & STANDARD K)

In this first group, three cables having different diameter ferrite rubber layers were made and tested for the standard K and each of the examples A–J. For all these cables the basic structure was the same, with the only difference being that the ferrite rubber layers of each of the examples A–J were additionally provided with a specific type and quantity of electrically conductive particles.

Namely, with reference once again to FIG. 2, the basic structure (as defined by the standard K) comprised a reinforcing core 2 having an outer diameter of 0.55–0.60 mm formed by twisting 2 1500-denier threads of aromatic polyamide fiber. The reinforcing core 2 was then covered with a ferrite rubber layer 3 by extrusion molding. The ferrite rubber used for this purpose was made by cross-linking a base polymer of silicone rubber containing Mn-Zn based ferrite powder, organic peroxide and low molecular weight siloxane in the proportions shown in Table 1.

In the beginning structure described above, the thickness of the ferrite rubber layer 3 was varied in order to make three separate cables. The specific thicknesses were chosen such that the ferrite rubber layers 3 of the three cables would have outer diameters of 0.9 mm, 1.1 mm and 1.3 mm, respectively.

Then, around the outer periphery of the ferrite rubber layers 3 of each cable a Ni-Cr alloy wire 4 was wound so as to create a wound conductor 5 having a resistance of 16kΩ per meter. The way in which this was accomplished was by winding Ni-Cr alloy wire having a resistance of 584Ω/m and an outer diameter of 0.045 mm at a rate of 97 turns/cm for the cable having the 0.9 mm diameter ferrite rubber layer 3; by winding Ni-Cr alloy wire having a resistance of 484Ω/m and an outer diameter of 0.050 mm at a rate of 96 turns/cm for the cable having the 1.1 mm diameter ferrite rubber layer 3; and by winding Ni-Cr alloy wire having a resistance of 424Ω/m and an outer diameter of 0.060 mm at a rate of 93 turns/cm for the cable having the 1.3 mm diameter ferrite rubber layer 3.

After the wound conductor 5 had been made for each of the three cables, a strip layer 6 of graphite powder was applied thereto, after which the wound conductor 5 was covered with an insulating layer 7 made from a blended composition of ethylene-propylene-diene ternary copolymer having a dielectric constant of 2.65. For each cable the insulating layer 7 was formed by extrusion molding to have an outer diameter of 4.8 mm.

Finally, the structure of each cable was completed by providing a reinforcing layer 8 of braided glass fiber over the insulating layer 7, and then extrusion molding over the reinforcing layer 8 a sheath 9 made from a silicone rubber composition. The structure having been completed, the final diameter of each cable (defined by the outer diameter of the sheath 9) measured 7 mm.

With reference to Table 1, the three cables constructed as described above were chosen as the standard K. After this, three corresponding cables (i.e., cables with ferrite layers having the three diameters 0.9 mm, 1.1 mm and 1.3 mm, respectively) were separately constructed for each of the examples A–J by adding a specific type and quantity of conductive particles (as shown in Table) to the ferrite rubber layer of the cable structure of the standard K.

After all the cables for the standard K and examples A–J had been constructed, they were tested by using the instrument shown in FIG. 3. Then, as shown in FIGS. 4–13, a separate graph was plotted showing the noise level at various frequencies for the three cables of each of the examples A–J. For comparison, in each graph there is additionally plotted the corresponding data for the three cables of the standard K.

From the comparison plots of examples A–J with standard K in the graphs of FIGS. 4–13, it is quite clear that the cables of all the examples A–J have far superior radio noise suppression characteristics than the cables of the standard K, especially in the 30–200 MHz frequency range. Thus, since the only difference between the standard K and the examples A–J is that in the latter case the ferrite rubber layer is additionally provided with conductive particles, the superior noise suppression characteristics of examples A–J can be directly linked to the provision of the conducting particles. Moreover, FIGS. 4–13 clearly show that sufficient radio noise suppression can be achieved for examples A–J even when the thickness of the ferrite rubber layer is made relatively small.

In addition, the electrostatic capacitance is very small and does not depend to any appreciable degree on the particular material chosen for the ferrite rubber layer. For the standard K and examples A–J described above, the electrostatic capacitance was 76–77 pF/m for the cables with 0.9 mm diameter ferrite rubber layers, 84 pF/m for the cables with 1.1 mm diameter ferrite rubber layers, and 93–94 pF/m for the cables with 1.3 mm diameter ferrite rubber layers.

GROUP 2 (EXAMPLES L & M AND STANDARDS N & O)

In this second group, only four cables were made and tested, and they can be divided into two examples L and M and two corresponding standards N and O, respectively.

Referring once again to FIG. 2, for the cables of examples L and M and standards N and O, 3 threads of 1000-denier aromatic polyester fiber were twisted together to form a reinforcing core 2 with an outer diameter of 0.55–0.60mm. Then, as indicated in Table 1, each reinforcing core 2 was covered by a specific ferrite rubber layer 3 having an outer diameter of 1.1 mm. For example L and standard N, the base polymer was EPDM and all constituents of the ferrite rubber layer 3 were the same except for the extra addition of conductive particles in the ferrite rubber layer 3 of example L. Similarly, for example M and standard 0, all the constituents of the ferrite rubber layer 3 were the same except for the addition of conductive particles in the ferrite rubber layer 3 of example M, with the base polymer for these cables being vinylidene fluoride fluororubber.

In examples L and M described above, carbon black was used for the conductive particles of their respective ferrite rubber layers. The specific type of carbon black used is known by the tradename "Toka Black #5500" (a product made by Tokai Carbon Co., Ltd.).

Next, after the reinforcing cores 2 of examples L and M and standards N and O had been covered with their respective ferrite rubber layers 3, a Ni-Cr alloy wire 4 having a resistance of 5500Ω/m and a diameter of 0.05 mm was wound at a rate of 84 turns/cm around the outer periphery of the ferrite rubber layers 3 to form wound conductors 5 having resistances of 16kΩ/m.

Lastly, the structures of the cables were completed in the same manner as was done for the cables of Group 1 by coating the wound conductors 5 with graphite powder, covering with a blended composition ethylene-propylendiene copolymer as the insulator 7, providing a reinforcing layer 8 of braided glass fiber, and then covering with a sheath 9 made from a silicone rubber composition. The cables thus completed, like the cables of Group 1, had an outside diameter of 7 mm.

Figure 14:
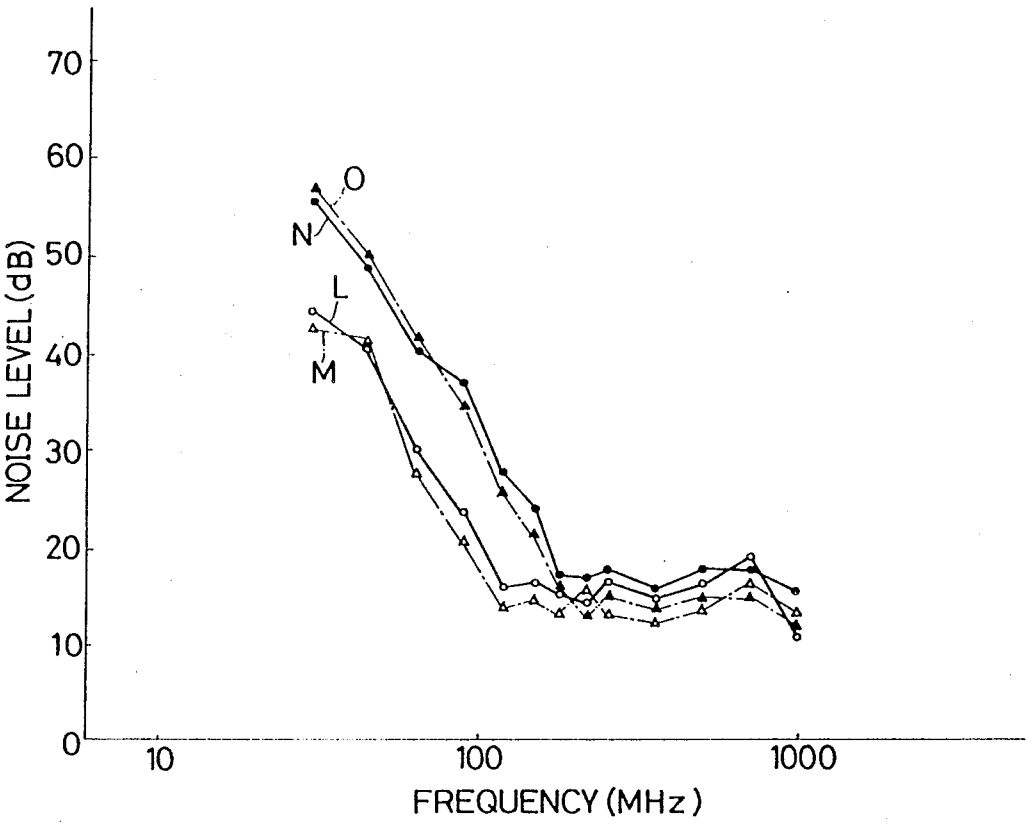

After the cables had been constructed, they were tested in the same manner as the cables of Group 1 by using the apparatus shown in FIG. 3. Then, as shown in FIG. 14, a single graph was made by plotting the noise levels of all the cables at various frequencies.

As was similarly found for examples A–J of Group 1, examples L and M have far superior radio noise suppression characteristics than their respective standards N and O. Moreover, the comparison of examples L and M with their respective standards N and O show that regardless of the choice of the base polymer used for the ferrite rubber layer, the provision of conductive particles will lead to improved radio noise suppression characteristics for high voltage cables.

Finally, it is to be understood that even though the present invention has been described in its preferred embodiments, many modifications and improvements may be made without departing from the scope of the invention as defined by the appended claims.

TABLE 1

| | Example A | Example B | Example C | Example D | Example E | Example F | Example G | Example H | Example I | Example J | Standard K |
|---|---|---|---|---|---|---|---|---|---|---|---|
| Silicone Rubber | 100 | 100 | 100 | 100 | 100 | 100 | 100 | 100 | 100 | 100 | 100 |
| Organic Peroxide | 2 | 2 | 2 | 2 | 2 | 2 | 2 | 2 | 2 | 2 | 2 |
| Low Molecular Weight Siloxane | 5 | 5 | 5 | 5 | 5 | 5 | 5 | 5 | 5 | 5 | 5 |
| Mn—Zn Based Ferrite | 600 | 600 | 600 | 600 | 600 | 600 | 600 | 600 | 600 | 600 | 600 |
| Conductive Particles | | | | | | | | | | | |
| Metallic Powder (Nickel Powder) | 20 | 40 | | | | | | | | | |
| Metallic Fiber (Stainless Steel Fiber) | | | 20 | 40 | | | | | | | |
| Graphite Powder | | | | | 20 | 40 | | | | | |
| Carbon Fiber (PAN-Series Milled Fiber) | | | | | | | 20 | 40 | | | |
| Carbon Black (Ketjen Black EC) | | | | | | | | | 20 | 40 | |

TABLE 2

| | Example L | Example M | Standard N | Standard O |
|---|---|---|---|---|
| EPDM | 100 | | 100 | |
| Fluororubber | | 100 | | 100 |
| Processing Aiding Agent | 6 | 6 | 6 | 6 |
| Plasticizer | 20 | 15 | 20 | 15 |
| Anti-Oxidant | 2 | | 2 | |
| Cross-Linking Aiding Agent | 15 | 15 | 15 | 15 |
| Cross-Linking Agent | 9 | 7 | 9 | 7 |
| Mn—Zn Based Ferrite | 700 | 700 | 700 | 700 |
| Toka Black #5500 | 40 | 40 | | |

What is claimed is:

1. A high voltage cable, comprising:

a reinforcing core;

a ferrite rubber coating formed around the core, the ferrite rubber comprising a mixture of about 100 parts by weight of a base polymer, from about 400 to about 700 parts by weight of a ferrite compound and from about 10 to about 50 parts by weight of electrically conductive particles selected from the group consisting of carbon black, carbon fiber, graphite powder, and graphite fiber, and wherein the rubber coating has a diameter less than about 1.3 mm; and a metallic wire wound at a spacing of about 30 to about 150 turns/cm around the ferrite rubber coating in order to form a wound electrical conductor.

2. The cable of claim 1, wherein the ferrite compound comprises a Mz-Zn based ferrite.

3. The cable of claim 1, wherein the base polymer comprises a rubber material selected from the group consisting of ethylene-propylene-diene ternary copolymer, silicone rubber, and fluororubber.

4. The cable of claim 1, wherein the reinforcing core comprises fibers selected from the group consisting of aromatic polyamide fibers and aromatic polyester fibers.

5. The cable of claim 1, further comprising an insulating layer formed over the wound conductor, and a strip layer provided between the wound conductor and the insulating layer for facilitating removal of the insulating layer when the wound conductor is to be exposed.

6. The cable of claim 5, further comprising a reinforcing layer formed over the insulating layer, and a cover sheath formed over the reinforcing layer.

7. A high voltage cable, comprising:

a reinforcing core;

a ferrite rubber coating formed around the core, the ferrite rubber comprising a mixture of about 100 parts by weight of a base polymer, from about 400 to about 700 parts by weight of a ferrite compound and from about 10 to about 50 parts by weight of electrically conductive particles selected from the group consisting of metallic powder and metallic fiber, and wherein the rubber coating has a diameter less than about 1.3 mm; and a metallic wire wound at spacing of about 30 to about 150 turns/cm around the ferrite rubber coating in order to form a wound electrical conductor.

8. The cable of claim 7, wherein the ferrite compound comprises a Mn-Zn based ferrite.

9. The cable of claim 7, wherein the base polymer comprises a rubber material selected from the group consisting of ethylene-propylene-diene ternary copolymer, silicone rubber, and fluororubber.

10. The cable of claim 7, wherein the reinforcing core comprises fibers selected from the group consisting of aromatic polyamide fibers and aromatic polyester fibers.

11. The cable of claim 7, further comprising an insulating layer formed over the wound conductor, and a strip layer provided between the wound conductor and the insulating layer for facilitating removal of the insulating layer when the wound conductor is to be exposed.

12. The cable of claim 11, further comprising a reinforcing layer formed over the insulating layer, and a cover sheath formed over the reinforcing layer.

13. A high voltage cable, comprising:

a reinforcing core;

a ferrite rubber coating formed around the core, the ferrite rubber comprising a mixture of about 100 parts by weight of a base polymer, from about 400 to about 700 parts by weight of a ferrite compound and from about 10 to about 50 parts by weight of electrically conductive particles selected from the group consisting of carbon black, carbon fiber, graphite powder, and graphite fiber, and wherein the rubber coating has a diameter less than about 1.3 mm; and a metallic wire wound at a spacing of about 30 to about 80 turns/cm around the ferrite rubber coating in order to form a wound electrical conductor.

14. The cable of claim 13, wherein the ferrite compound comprises a Mn-Zn based ferrite.

15. The cable of claim 13, wherein the base polymer comprises a rubber material selected from the group consisting of ethylene-propylene-diene ternary copolymer, silicone rubber, and fluororubber.

16. The cable of claim 13, wherein the reinforcing core comprises fibers selected from the group consisting of aromatic polyamide fibers and aromatic polyester fibers.

17. The cable of claim 13, further comprising an insulating layer formed over the wound conductor, and a strip layer provided between the wound conductor and the insulating layer for facilitating removal of the insulating layer when the wound conductor is to be exposed.

18. The cable of claim 17, further comprising a reinforcing layer formed over the insulating layer, and a cover sheath formed over the reinforcing layer.

* * * * *